US010781805B2

(12) United States Patent
Kim

(10) Patent No.: US 10,781,805 B2
(45) Date of Patent: Sep. 22, 2020

(54) SMALL AIR COMPRESSOR

(71) Applicant: NEW MOTECH CO., LTD., Gwangju (KR)

(72) Inventor: Jong Hyuk Kim, Gwangju (KR)

(73) Assignee: NEW MOTECH CO., LTD., Gwangju (KR)

( * ) Notice: Subject to any disclaimer, the term of this patent is extended or adjusted under 35 U.S.C. 154(b) by 153 days.

(21) Appl. No.: 16/068,127

(22) PCT Filed: Mar. 3, 2017

(86) PCT No.: PCT/KR2017/002313

§ 371 (c)(1),
(2) Date: Jul. 4, 2018

(87) PCT Pub. No.: WO2017/155243

PCT Pub. Date: Sep. 14, 2017

(65) Prior Publication Data

US 2019/0010938 A1 Jan. 10, 2019

(30) Foreign Application Priority Data

Mar. 7, 2016 (KR) ..... 10-2016-0026872
Mar. 7, 2016 (KR) ..... 10-2016-0026879

(51) Int. Cl.
*F04B 39/00* (2006.01)
*F04B 39/04* (2006.01)
(Continued)

(52) U.S. Cl.
CPC ..... *F04B 39/0276* (2013.01); *F04B 39/0005* (2013.01); *F04B 39/0061* (2013.01);
(Continued)

(58) Field of Classification Search
None
See application file for complete search history.

(56) References Cited

U.S. PATENT DOCUMENTS 4,406,590 A * 9/1983 Kessler ..... F04B 39/122 123/193.1
4,406,593 A * 9/1983 Kessler ..... F04B 39/122 248/618

(Continued)

FOREIGN PATENT DOCUMENTS

CN 203742952 U 7/2014
CN 104121163 A 10/2014

(Continued)

OTHER PUBLICATIONS

International Search Report for PCT/KR2017/002313 dated Jun. 16, 2017 from Korean Intellectual Property Office.

(Continued)

*Primary Examiner* — Peter J Bertheaud
*Assistant Examiner* — Geoffrey S Lee
(74) *Attorney, Agent, or Firm* — Revolution IP, PLLC

(57) ABSTRACT

A cylinder coupling structure of a small air compressor according to the present invention, in which a cylinder is integrally coupled to a block by which a crankshaft is shaft-supported, wherein the block is provided with a supporting end by which the cylinder is pressed to be supported; a latching end is formed on the outer surface of the cylinder; and a press bolt is fastened to the block and a valve cover so that the valve cover presses the front end of the cylinder while the latching end of the cylinder is latched and supported on the supporting end.

9 Claims, 19 Drawing Sheets

(51) Int. Cl.
*F04B 39/10* (2006.01)
*F04B 39/12* (2006.01)
*F04B 39/02* (2006.01)

(52) U.S. Cl.
CPC ..... *F04B 39/0094* (2013.01); *F04B 39/042* (2013.01); *F04B 39/1066* (2013.01); *F04B 39/122* (2013.01); *F04B 39/125* (2013.01)

(56) References Cited

U.S. PATENT DOCUMENTS 4,529,365 A * 7/1985 Schutt ..... F04B 39/121 417/313
4,559,686 A * 12/1985 Kessler ..... F04B 39/122 123/193.6
5,173,034 A * 12/1992 Riffe ..... F04B 39/0061 417/312
5,220,811 A * 6/1993 Harper ..... F04B 39/0072 181/403
5,224,840 A * 7/1993 Dreiman ..... F04B 39/06 181/403
5,288,212 A * 2/1994 Lee ..... F04B 39/125 181/229
5,451,727 A * 9/1995 Park ..... F04B 39/123 181/229
5,577,898 A * 11/1996 Lee ..... F04B 39/0072 417/312
6,305,912 B1 * 10/2001 Svendsen ..... F04B 39/0072 29/888.02
6,401,594 B1 * 6/2002 Rozek ..... F04B 39/14 74/587
6,558,137 B2 * 5/2003 Tomell ..... F04B 39/0055 181/256
6,776,589 B2 * 8/2004 Tomell ..... F04B 39/0055 417/269
7,435,060 B2 * 10/2008 Kim ..... F04B 39/0072 417/312
8,297,957 B2 * 10/2012 Park ..... F04B 39/1073 417/565
2007/0020127 A1 1/2007 Park et al.
2009/0175746 A1 * 7/2009 Park ..... F04B 39/1066 417/520
2012/0063937 A1 * 3/2012 Moreira ..... F04B 53/002 417/437

FOREIGN PATENT DOCUMENTS

JP 57-86662 A 5/1982
JP 63-101363 U 7/1988
JP 4-052473 Y2 12/1992
JP 6-137272 A 5/1994
JP 2000-303958 A 10/2000
JP 2000303958 A * 10/2000
KR 20-0122684 Y1 9/1995
KR 20-0151372 Y1 7/1999
KR 20-0387141 Y1 6/2005
KR 10-2006-0115809 A 11/2006
KR 10-0709948 B1 4/2007
KR 10-2010-0081807 A 7/2010
KR 10-1073763 B1 10/2011
WO 2015-025416 A1 2/2015

OTHER PUBLICATIONS

Esposito, Anthony., Fluid Power With Applications 3rd ed., Prentice-Hall, Inc., 1993, pp. 512-518.

* cited by examiner

[Fig. 1a]
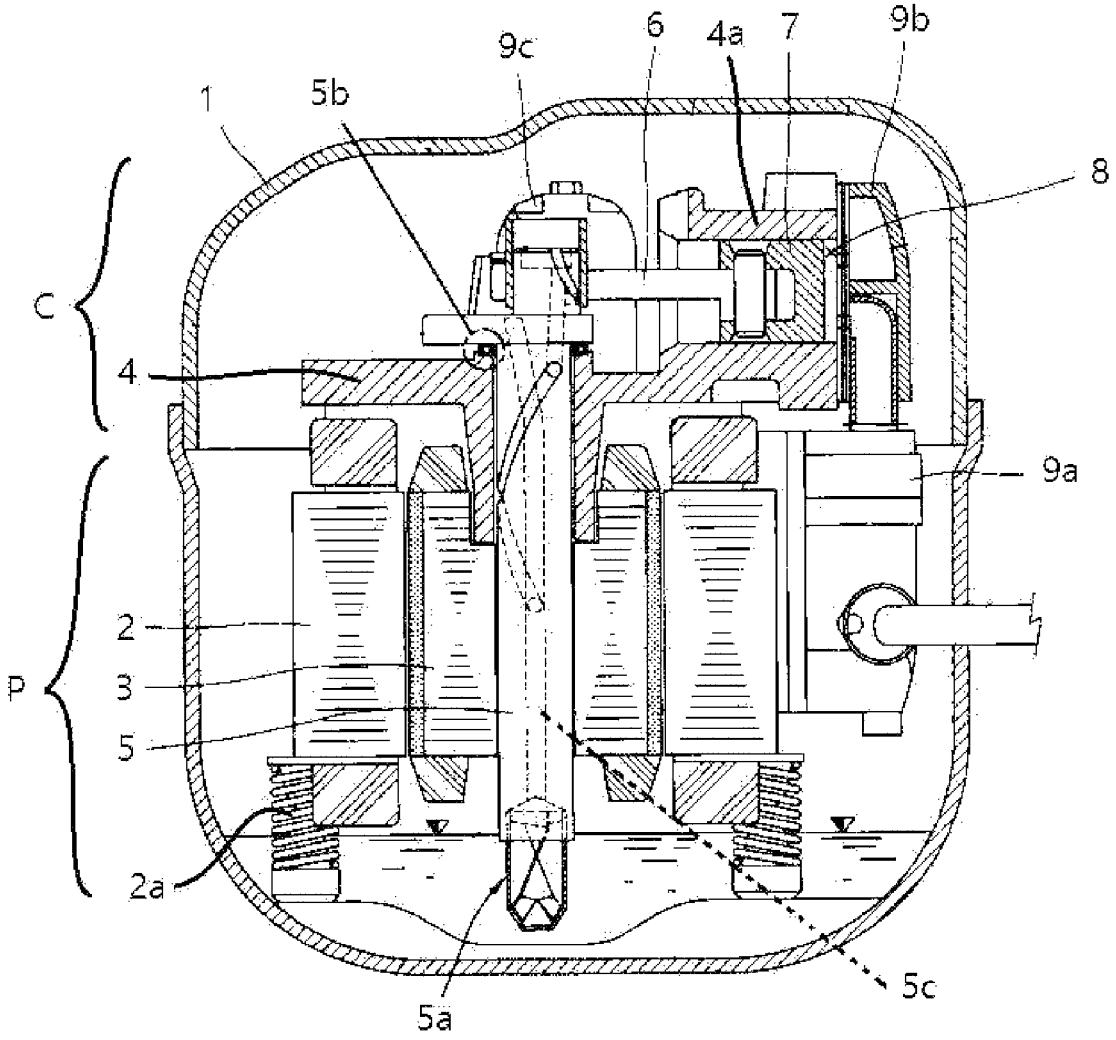

[Fig. 1b]
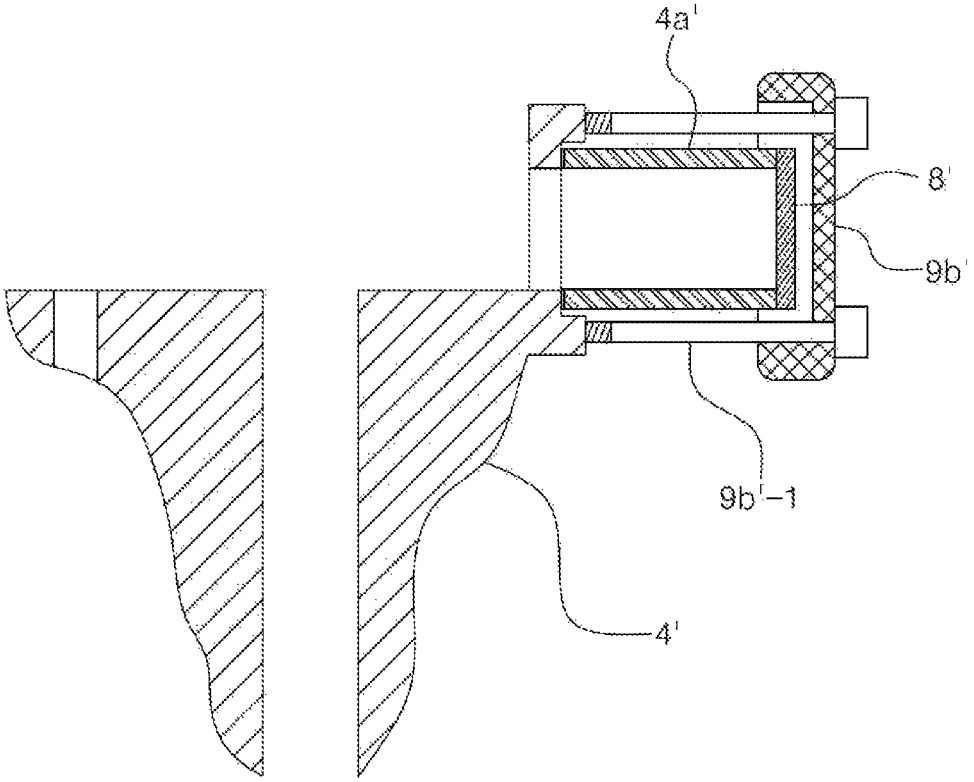
[Fig. 1c]
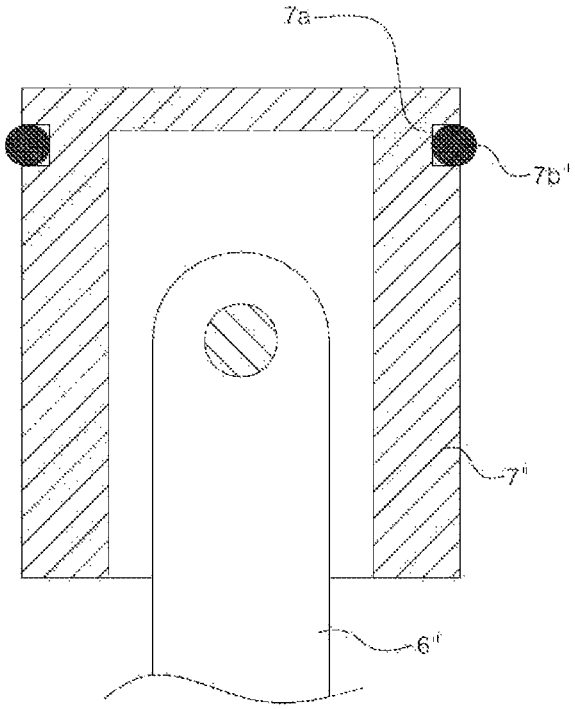

[Fig. 2a]
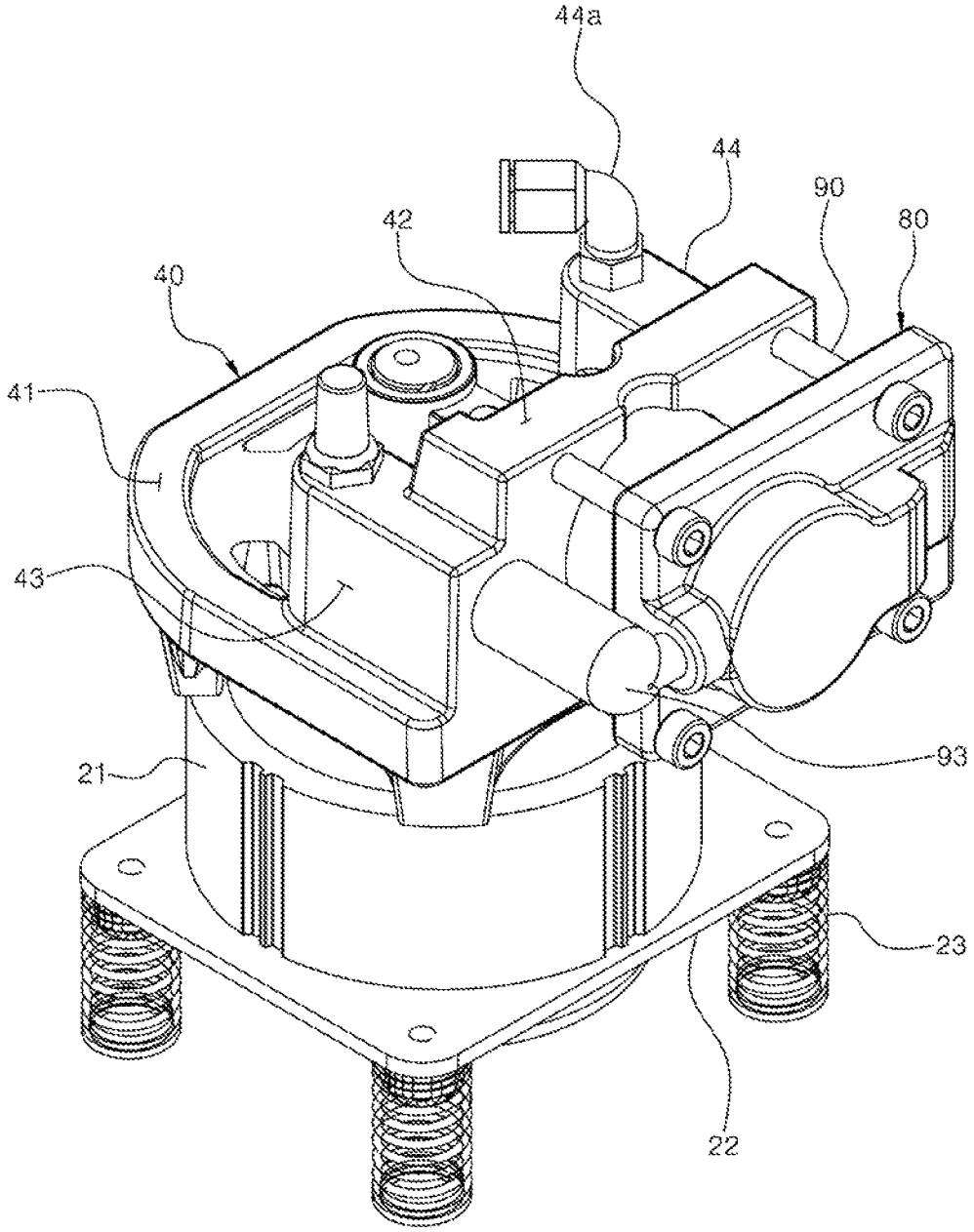

[Fig. 2b]
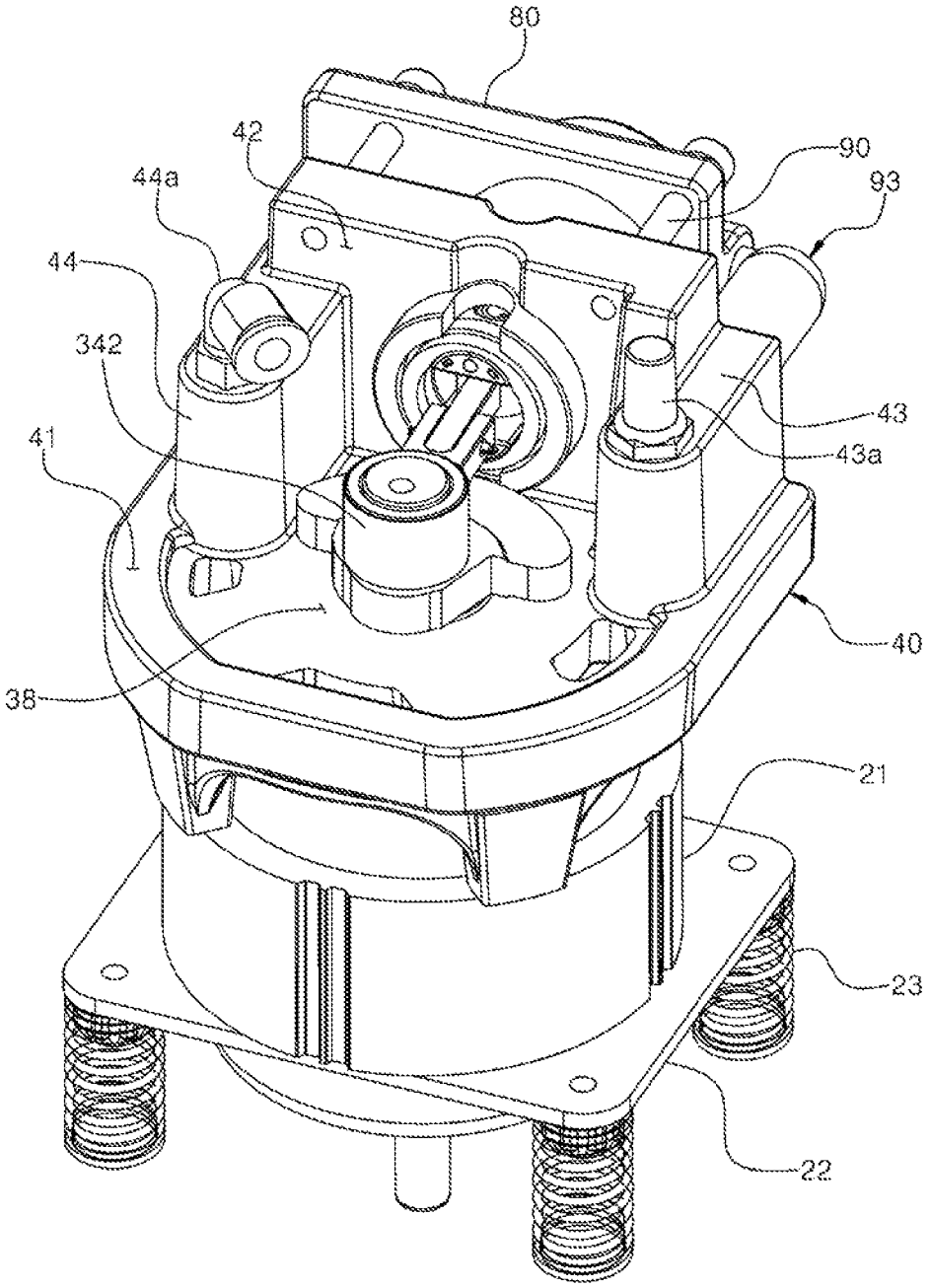

[Fig. 2c]
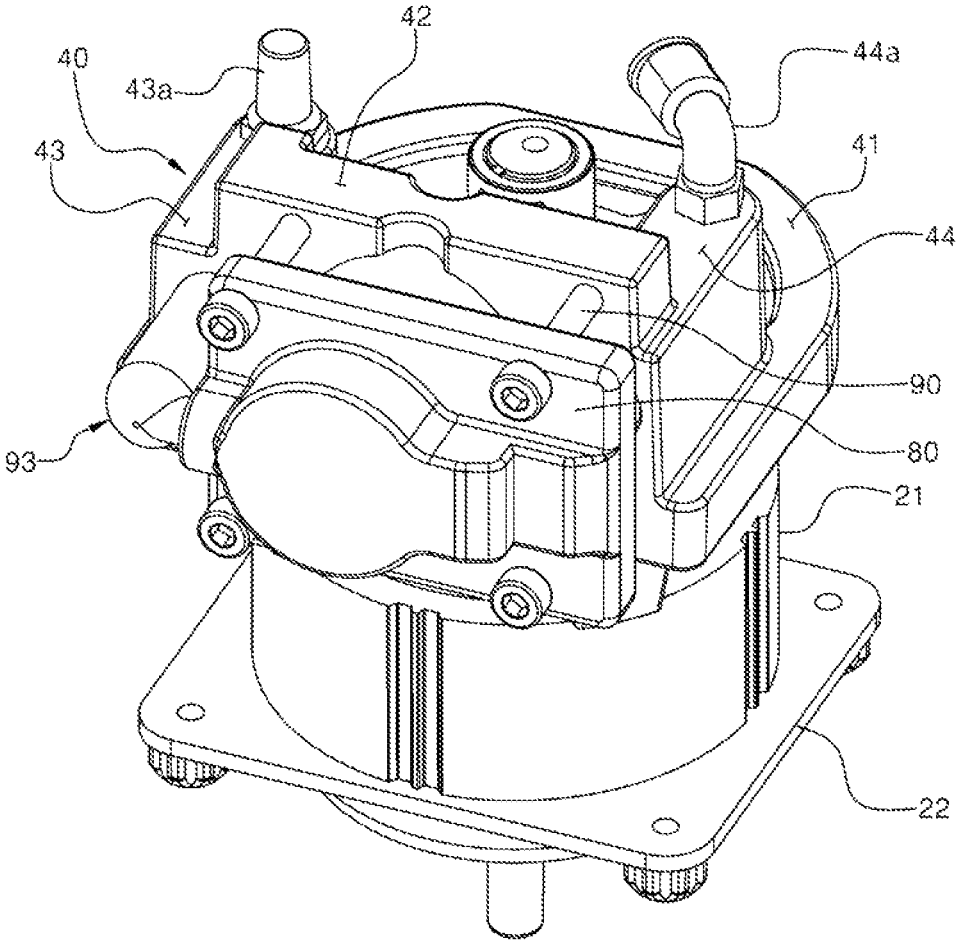

[Fig. 3]
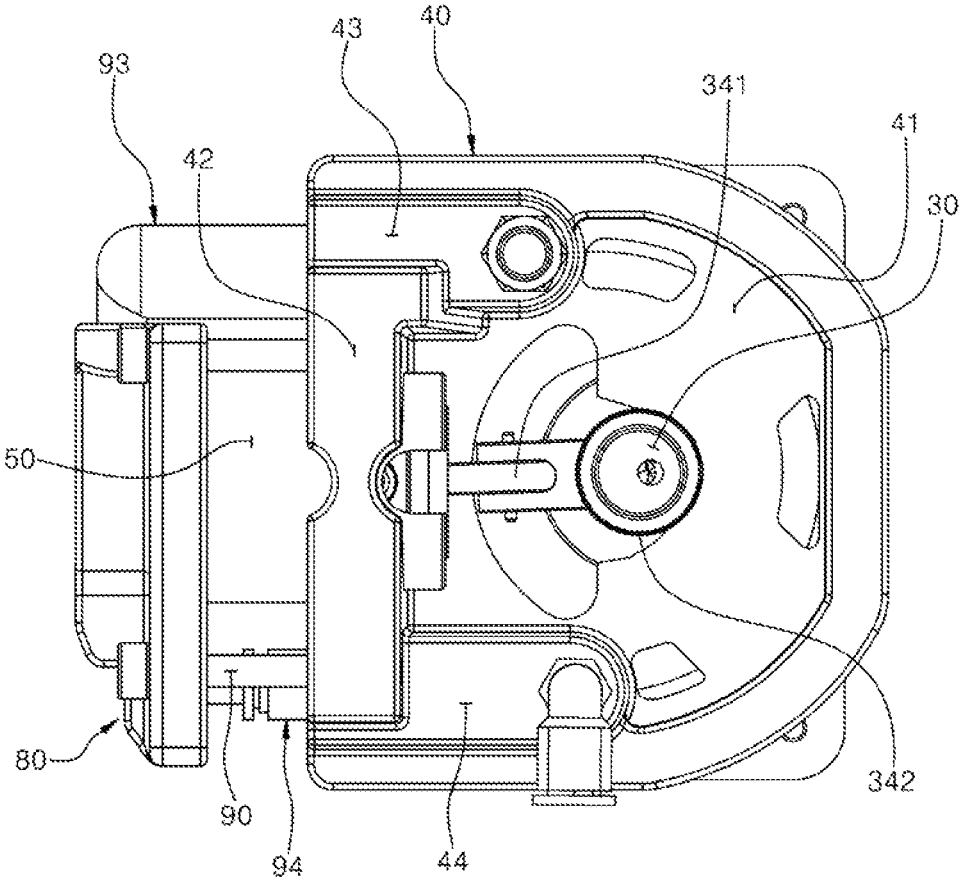

[Fig. 4]
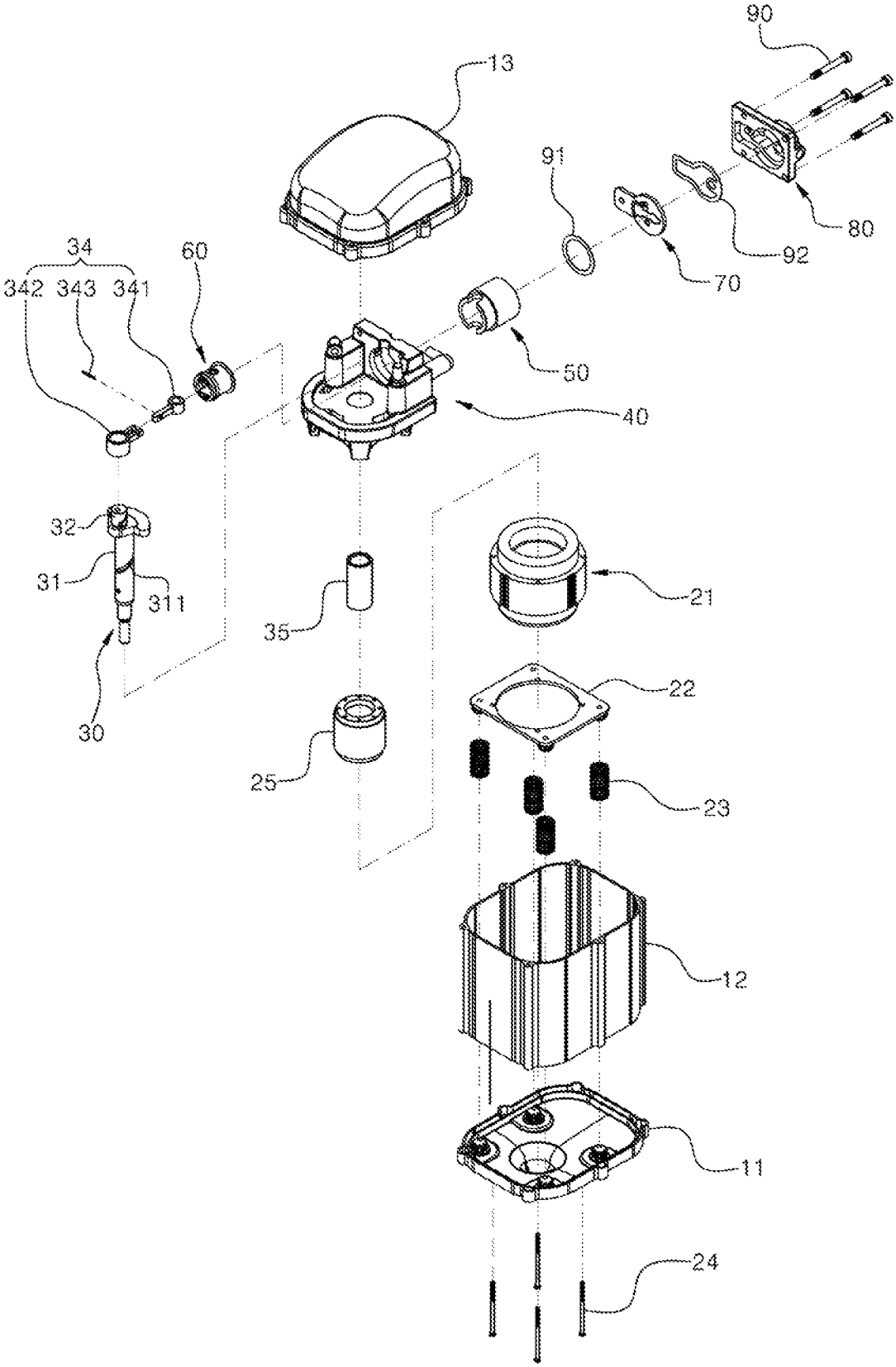

[Fig. 5]
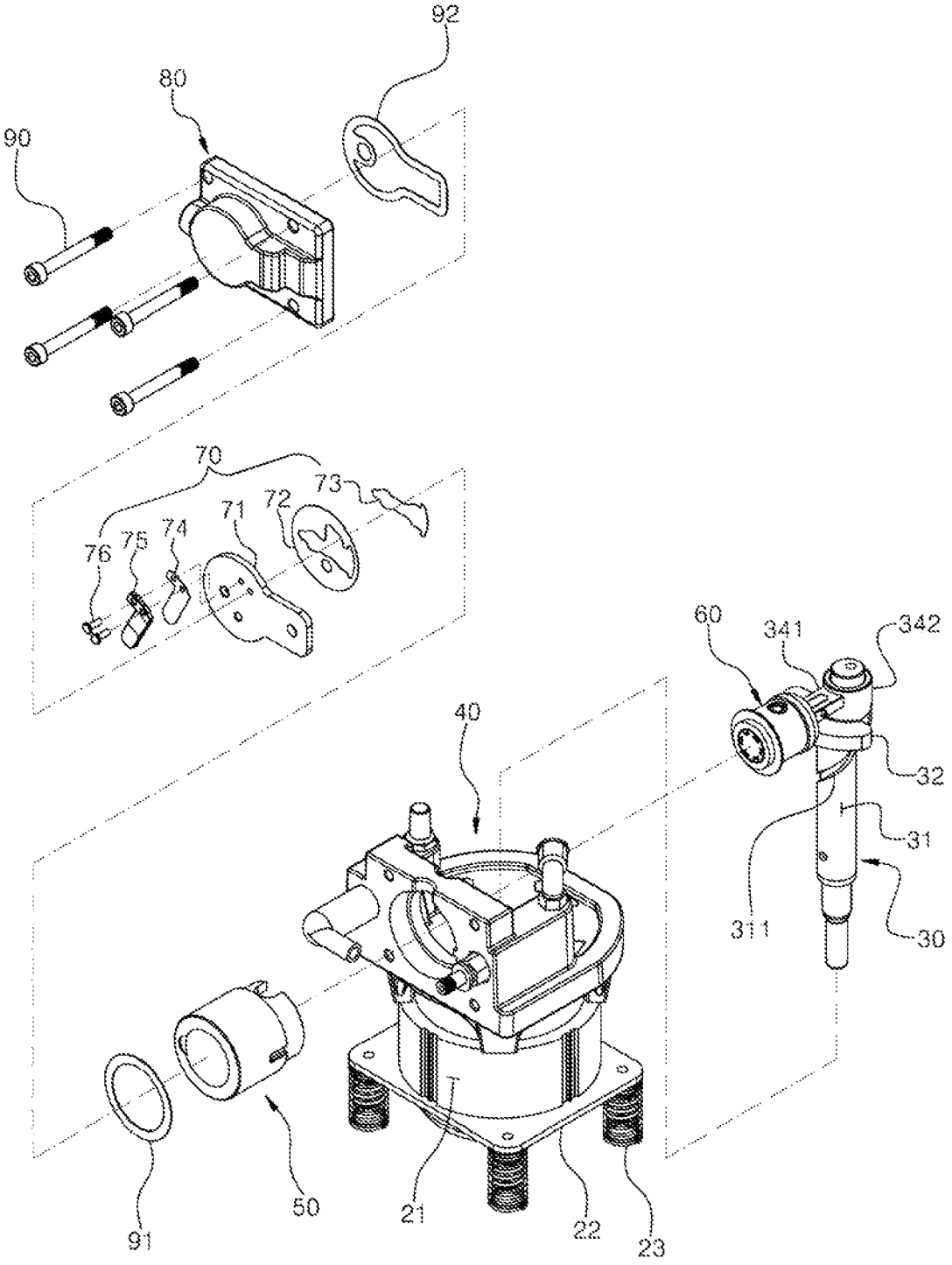

[Fig. 6]
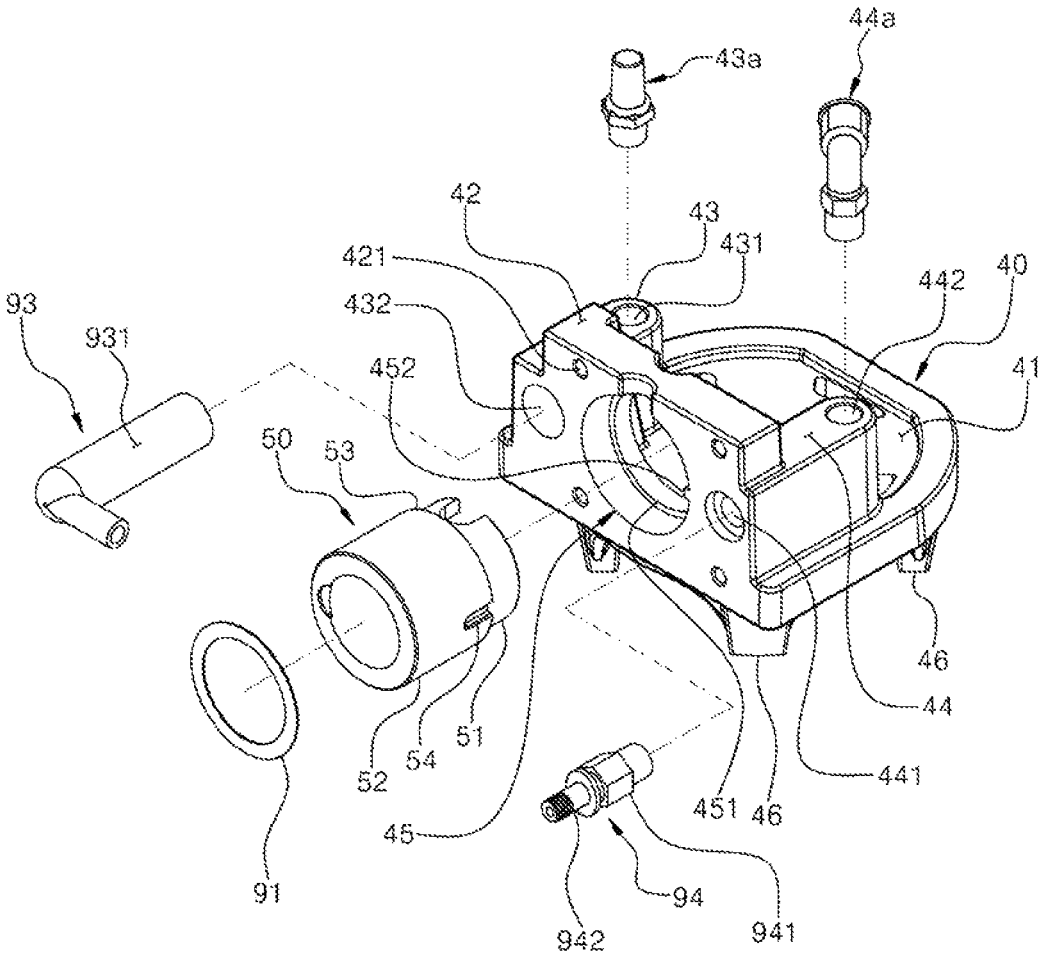

[Fig. 7]
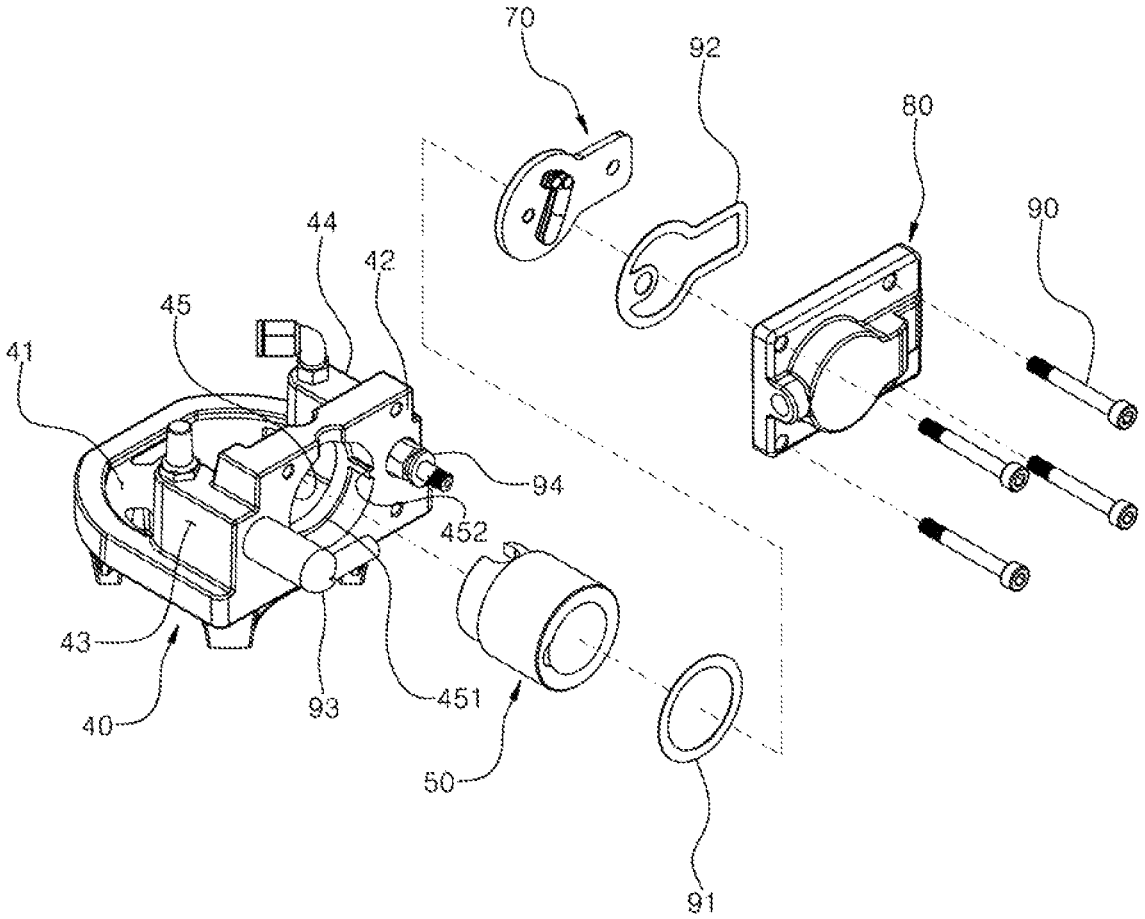

[Fig. 8]
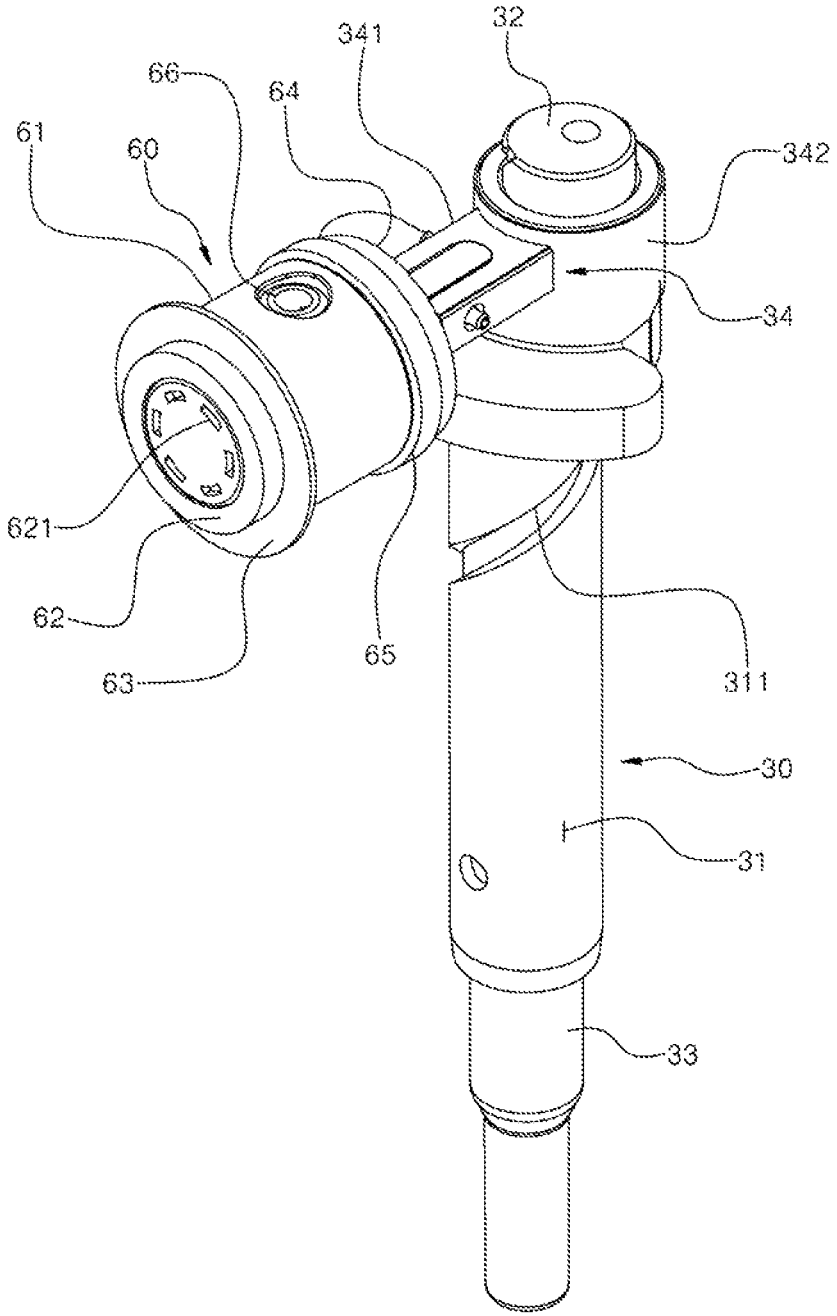

[Fig. 9a]
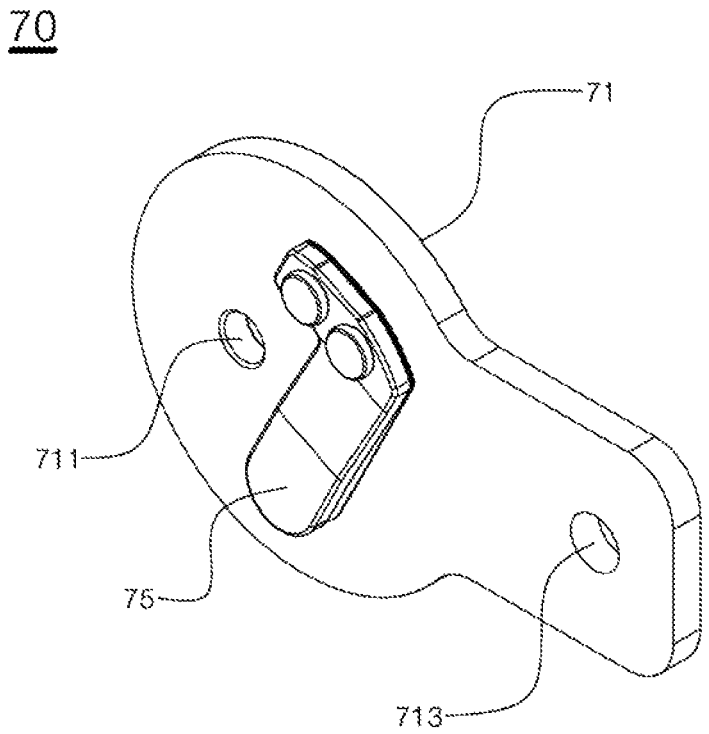
[Fig. 9b]
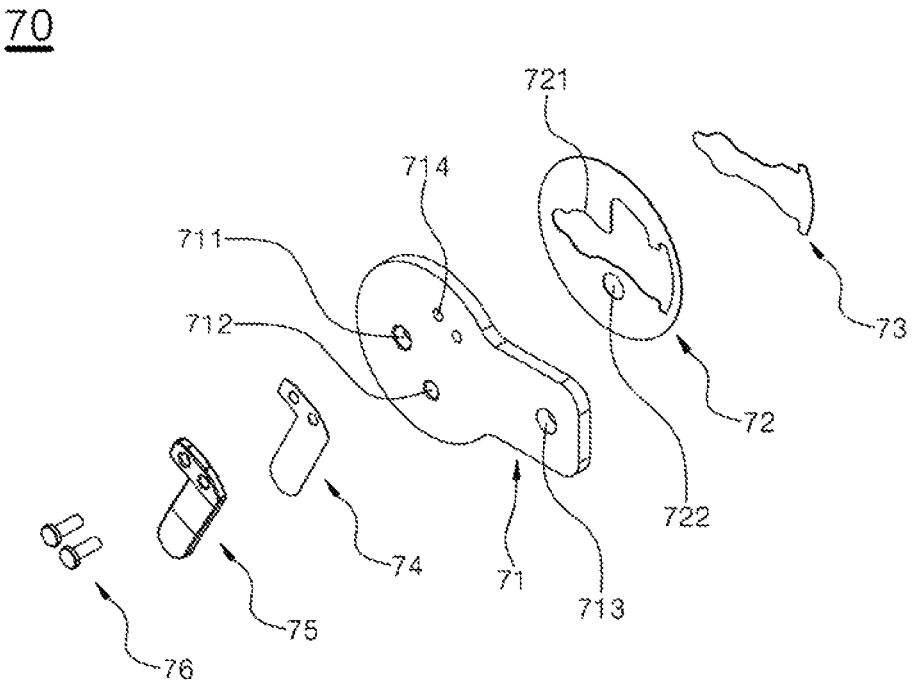

[Fig. 10]
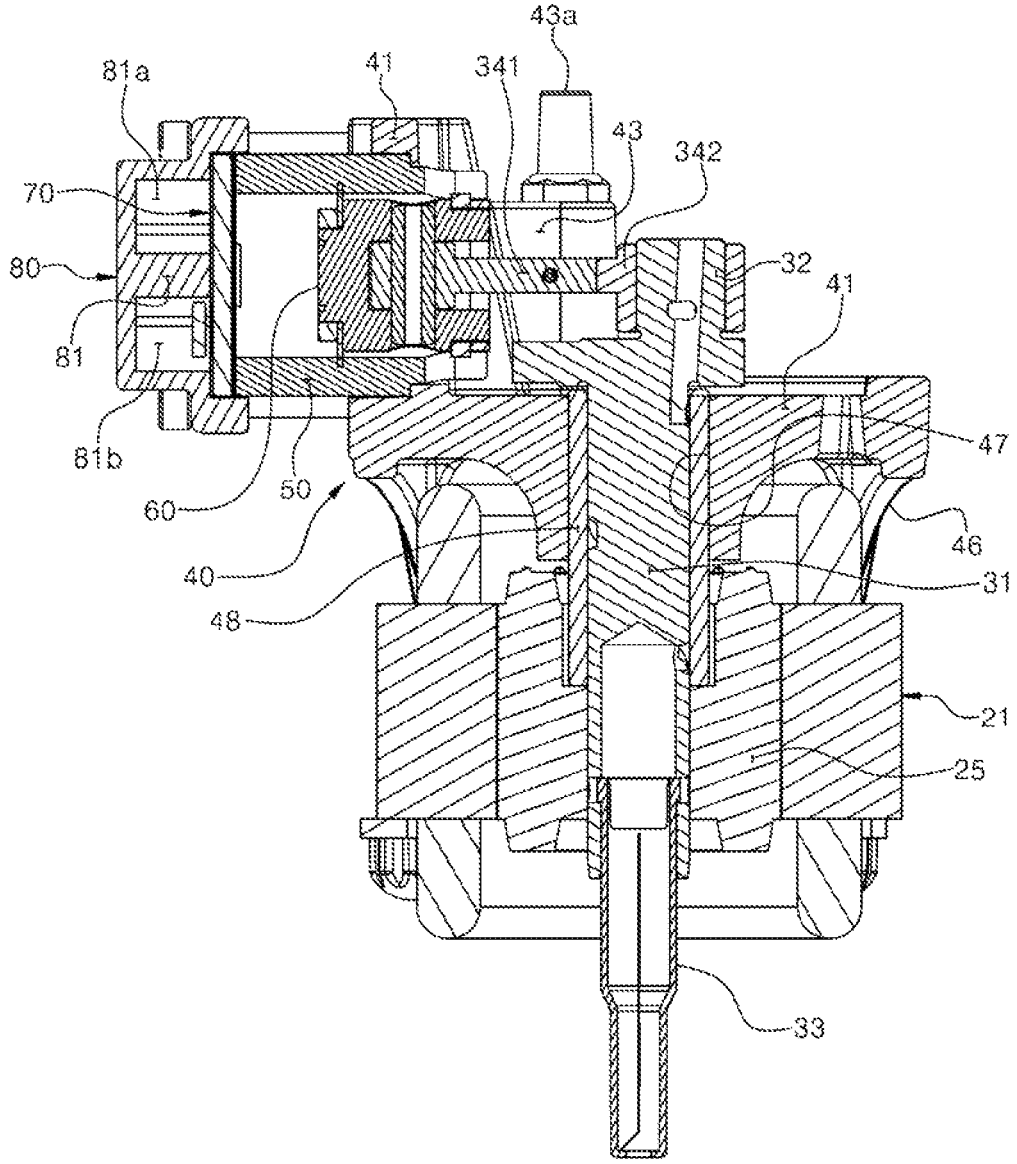

[Fig. 11]
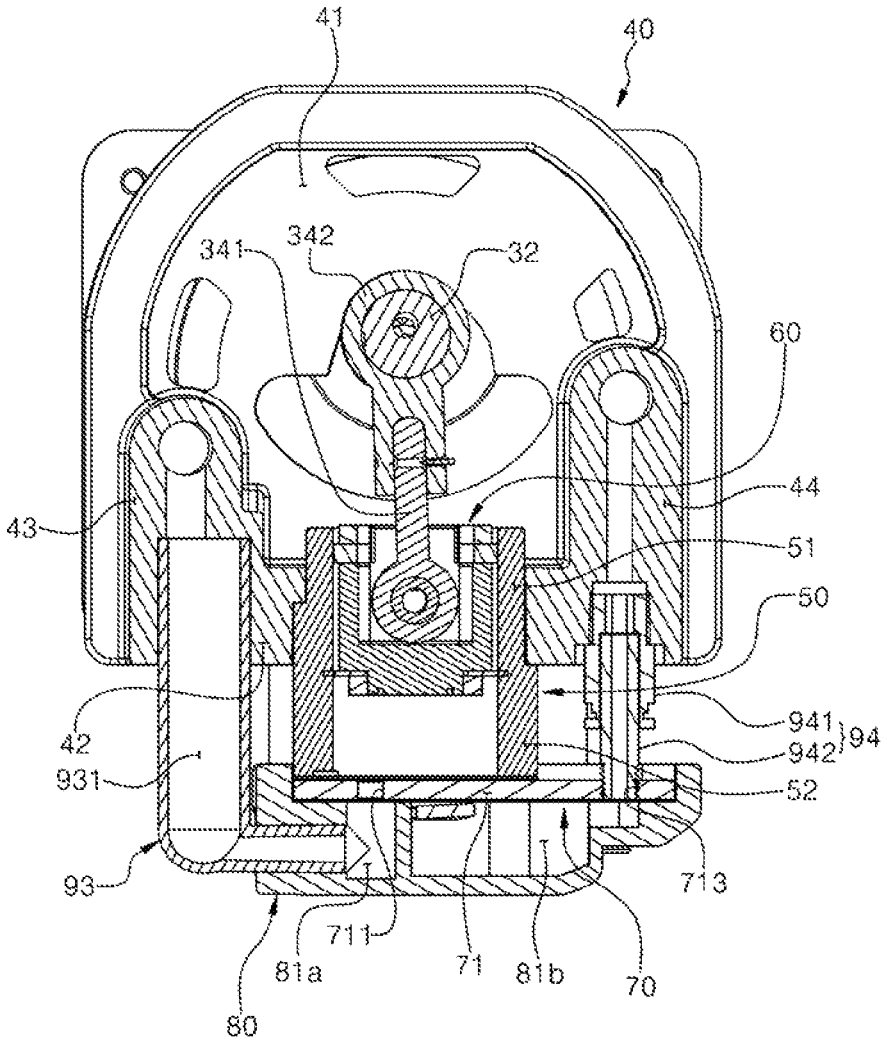

[Fig. 12]
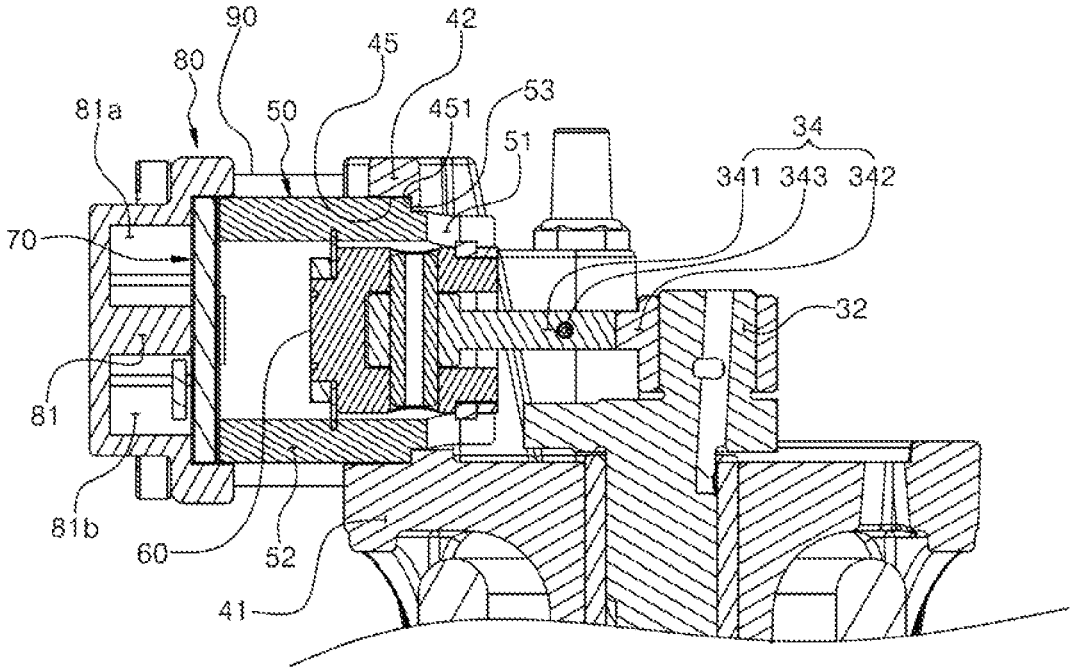

[Fig. 13]
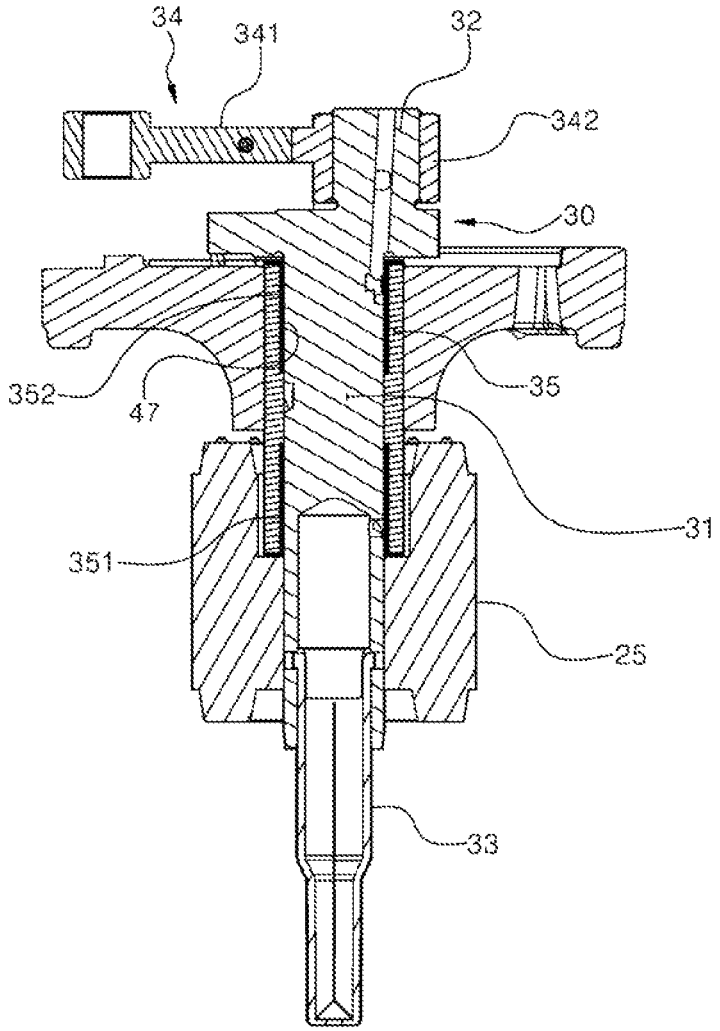

[Fig. 14a]
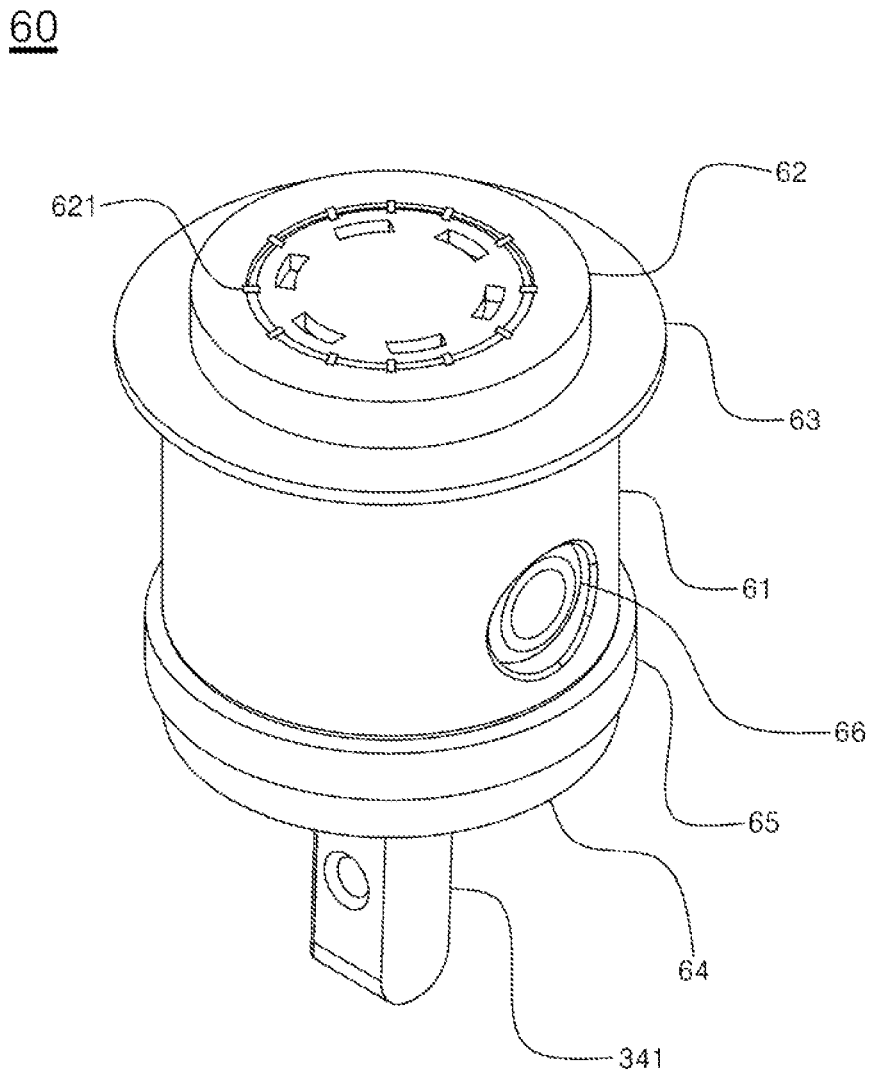

[Fig. 14b]
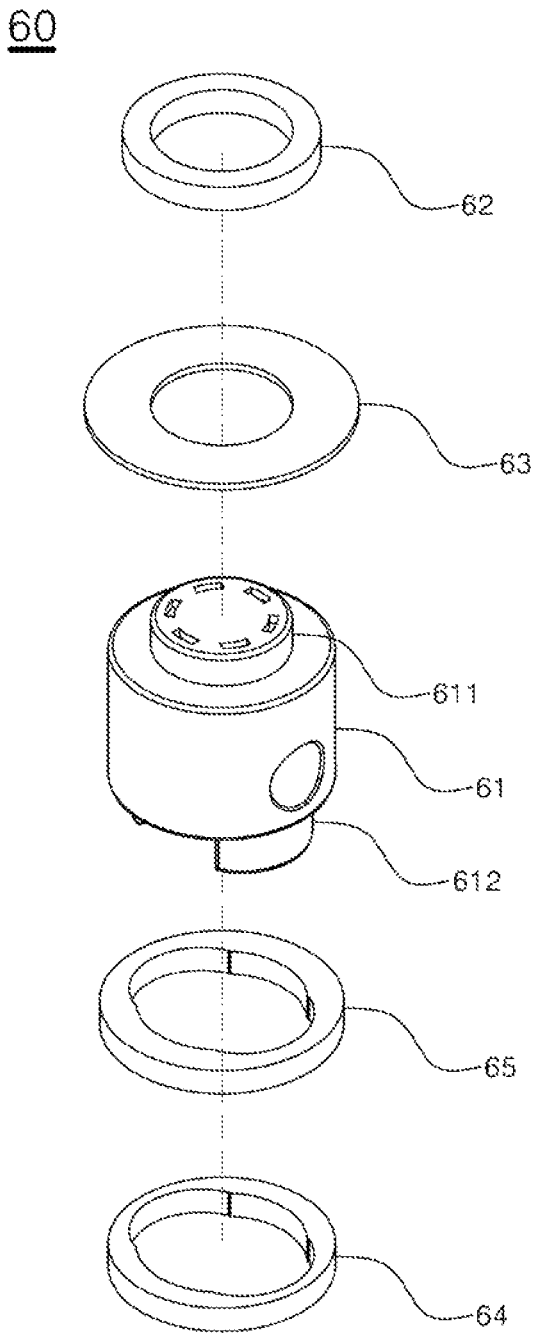

[Fig. 14c]
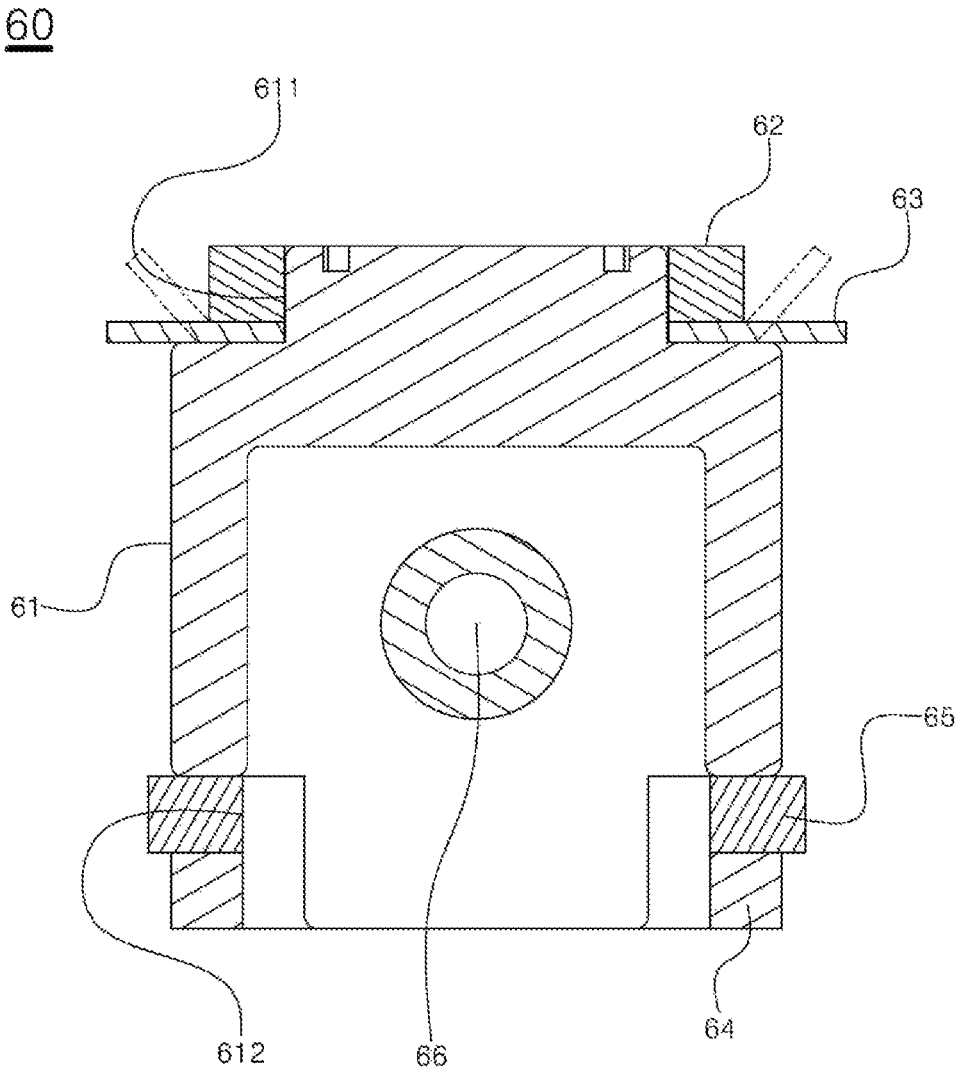

SMALL AIR COMPRESSOR

TECHNICAL FIELD

The present invention relates to a small air compressor. More specifically, the present invention relates to a cylinder coupling structure of a small air compressor capable of reducing the size and weight of a compressor by manufacturing a cylinder of a reciprocating piston type compressor suctioning and compressing fluid such as air or a refrigerant gas separately from a block and coupling the cylinder to the block.

BACKGROUND ART

Compressors are used to produce compressed air or to compress fluid such as refrigerant gas. Compressors are mainly classified into reciprocating piston type compressors which compress air by a reciprocating motion of a piston in a cylinder, and rotary vane type compressors which compress air by rotating a rotator in the cylinder. Rotary vane type air compressors make less noise, but are applied only to large compressors mostly of 20 HP or more because there are difficulties in producing small products. Reciprocating piston type compressors are applied to products in various sizes, mostly of 20 HP or less.

Korean Utility Model Registration No. 20-0387141 discloses a reciprocating piston type compressor for compressing air. Korean Patent Registration No. 10-1073763, Korean Utility Model Registration No. 20-0122684 and Korean Patent Laid-Open No. 10-2010-0081807 disclose small reciprocating piston type, i.e., reciprocating, compressors for compressing a refrigerant of a refrigerating apparatus.

FIG. 1*a* illustrates a small reciprocating compressor disclosed in Korean Patent Laid-Open No. 10-2010-0081807. Referring to FIG. 1*a*, conventionally, the typical small reciprocating compressor for compressing a refrigerant gas includes a power unit P generating rotation power inside a case 1 and a compression unit C converting a rotary motion of the power unit P into a reciprocating motion and compressing a refrigerant gas. The power unit P includes a stator 2 elastically supported by springs 2*a* and a rotor 3 rotatably installed inside the stator 2.

The compression unit C includes a block 4 coupled to the stator 2 while integrally having a cylinder unit 4*a* to form a compression space; a crankshaft 5 inserted into a shaft support hole in the block 4 to be supported in the radial direction and axial direction and coupled to the rotor 3 of the power unit P to transfer a rotational force; a connecting rod 6 rotatably coupled to a cam portion of the crankshaft 5 and converting a rotary motion into a linear motion; a piston 7 rotatably coupled to the connecting rod 6 and linearly reciprocating in the cylinder 4*a* to compress a refrigerant; a valve assembly 8 coupled to the front end of the cylinder 4*a* and provided with a suction valve and a discharge valve; a suction muffler 9*a* coupled to the suction side of the valve assembly 8; a discharge cover 9*b* coupled to accommodate the discharge side of the valve assembly 8; and a discharge muffler 9*c* communicating with the discharge cover 9*b* to attenuate discharge noise of a refrigerant discharged.

When power is applied to the power unit P, in the small reciprocating compressor as above, the rotor 3 rotates together with the crankshaft 5 by an interaction force between the stator 2 and the rotor 3, the connecting rod 6 coupled to the cam portion of the crankshaft 5 performs an orbiting motion, the piston 7 coupled to the connecting rod 6 linearly reciprocates in the cylinder 4*a*, compresses a refrigerant suctioned inside the cylinder 4*a* through the suction muffler 9*a* and discharges the refrigerant to the valve cover 9*b*, and the refrigerant discharged to the valve cover 9*b* is emitted through the discharge muffler 9*c*.

In the conventional small reciprocating compressor as illustrated in FIG. 1*a*, however, the cylinder 4*a* is formed integrally with the block 4, leading to large size. Thus, there are disadvantages that the conventional small reciprocating compressor needs a large amount of casting or die-casting materials for manufacturing the block 4 and are heavier, resulting in high costs for distribution such as transportation costs.

In order to overcome the problems such a conventional small reciprocating piston type compressor has, a small reciprocating compressor was disclosed, as illustrated in FIG. 1*b*, with a structure in which a cylinder 4*a*' having a tube-shape body is manufactured separately from a block 4', one end of the cylinder 4*a*' is brought into contact with the block 4', and a valve cover 9*b*' and the block 4' are coupled to each other with a press bolt 9*b*'-1 such that the valve cover 9*b*' presses the other end of the cylinder 4*a*' while a valve assembly 8' is coupled to the other end of the cylinder 4*a*'.

However, in the case of the small reciprocating compressor illustrated in FIG. 1*b*, the deformation of the cylinder 4*a*' occurs relatively easily because the cylinder 4*a*' with a tube-shaped body has a relatively long length, and both ends of the cylinder 4*a*' having a long length are supported on the block 4' and the valve cover 9*b*', respectively, and pressed by the fastening of the press bolt 9*b*'-1. Further, deformation occurs relatively easily during fastening or operating because the press bolt 9*b*'-1 for fixing the cylinder 4*a*' also has a long length, and thus the cylinder 4*a*' is not precisely coupled to the block 4' but twisted, which is a problem. The deformation of the cylinder 4*a*' or uneven coupling of the cylinder 4*a*' as above increases friction of a piston reciprocating therein, and accordingly causes problems of generating noise and significantly degrading durability as well.

Meanwhile, the small reciprocating compressor illustrated in FIG. 1*a* has a structure in which the suction muffler 9*a* and the discharge muffler 9*b* for reducing noise generated from pulsation of air or a refrigerant gas compressed by the reciprocating motion of the piston 7 are manufactured separately from the block 4 and coupled to the valve cover 4 with a tube. Such structure is a factor which makes the structure of the compressor complicated and increases the manufacturing costs.

Also, in the case of the small reciprocating compressor illustrated in FIG. 1*a*, the crankshaft 5 is inserted into the shaft support hole in the block 4 such that both side end portions thereof are shaft-supported by a bearing 5*b* in the axial direction and radial direction. In this regard, much vibration is generated in the crankshaft 5. The vibration readily damages a ball bearing typically used, and oil feeding is inevitably necessary for reducing vibration and improving durability. Accordingly, the conventional small reciprocating compressor illustrated in FIG. 1 adopts a structure in which oil in the oil storage unit in the case 1 is pumped by an oil feeder 5*a* and supplied to the bearing 5*b* through an oil path 5*c* formed in the crankshaft 5. Part of the oil supplied in such a manner is supplied to the cylinder 4*a* to reduce the friction between the piston 7 and the cylinder 4*a*.

Meanwhile, FIG. 1*c* illustrates the structure of a piston of another conventional small reciprocating compressor. Conventionally, the compressor has a structure in which a ring insertion groove 7*a*" is formed around the outer circumference in the upper end portion of a piston 7" to which a connecting rod 6" is rotatably connected, and an O-ring **7*b*" made of rubber is inserted into the ring insertion groove 7*a*" to seal a gap between the piston 7" and the inner surface of the cylinder. However, since the conventional piston 7" has a structure in which the O-ring 7*b*" installed only in the upper end portion is in close contact with the inner surface of the cylinder, left and right vibration of the piston 7" occurs when the piston 7" reciprocates, which is a problem. In addition, since the O-ring 7*b*"** is made of rubber, it has disadvantages of high friction upon contacting the inner surface of the cylinder and degradation in durability.

DETAILED DESCRIPTION OF INVENTION

Technical Task

The present invention was invented by recognizing the aforementioned problems. It is an object of the present invention to provide a small air compressor that can reduce cylinder deformation by forming a supporting end at the side of a cylinder and allowing the supporting end to be supported on a block and also, as a result, precisely retain the coupling of the cylinder and the block upon fastening and operating by reducing the length of a press bolt coupling a valve cover and the block.

It is another object of the present invention to provide a small air compressor of simple structure and easy assembling by forming a suction muffler and a discharge muffler integrally with a block.

It is another object of the present invention to provide a small air compressor that can reduce the vibration of a crankshaft and improve the durability of a bearing by inserting bushings into the inside of a shaft support hole in a block and installing journal bearings at both ends thereof to support the crankshaft by the journal bearings and also, as a result, allow an oil-free compressor.

It is another object of the present invention to provide a small air compressor that can reduce the vibration of a piston by installing sealing rings at both upper and lower ends of the piston.

Method for Solving the Technical Task

In order to achieve the aforementioned objects, a small air compressor according to the present invention includes a block; a cylinder having a tube-shaped body, coupled to the block; a valve assembly provided with a suction valve and a discharge valve, blocking the front end of the cylinder; a valve cover covering the valve assembly to form a suction space and a discharge space on the top of the valve assembly; at least one press bolt coupling the valve cover and the block such that the cylinder is pressed between the valve cover and the block; a piston reciprocating inside the cylinder; a stator coupled to the block; a rotor positioned to rotate relative to the stator; a crankshaft coupled with the rotor to rotate integrally with the rotor, rotatably shaft-supported on the block; and a connecting rod having both ends connected to the crankshaft and the piston, respectively, to convert a rotary motion of the crankshaft into a linear reciprocating motion of the piston, wherein the block is provided with a supporting end by which the cylinder is pressed to be supported, a latching end is formed on the outer surface of the cylinder, and the press bolt is fastened to the block and the valve cover such that the valve cover presses the front end of the cylinder while the latching end of the cylinder is latched and supported on the supporting end.

Also, the small air compressor according to the present invention is characterized in that the block is formed with a cylinder insertion hole penetrating therethrough into which one end portion of the cylinder is inserted, that the supporting end is formed by a step formed in the inner wall of the cylinder insertion hole, and that the cylinder is inserted into the cylinder insertion hole and the latching end is latched and supported on the supporting end.

Also, the small air compressor according to the present invention is characterized in that a guide protrusion is formed on any one of the inner surface of the cylinder insertion hole and the outer surface of the cylinder contacting each other, and that a guide groove into which the guide protrusion is inserted while the cylinder is inserted into the cylinder insertion hole is formed on the other one of the inner surface of the cylinder insertion hole and the outer surface of the cylinder.

Also, the small air compressor according to the present invention is characterized in that the block is formed integrally with a suction muffler part and a discharge muffler part each having an inlet and an outlet, that a suction connection tube is connected to the outlet of the suction muffler part such that the suction muffler part is connected to the suction space of the valve cover, and that a discharge connection tube is connected to the inlet of the discharge muffler part such that the discharge muffler part is connected to the discharge space of the valve cover.

Also, the small air compressor according to the present invention is characterized in that the suction connection tube is formed with an auxiliary suction muffler part.

Also, the small air compressor according to the present invention is characterized in that the discharge connection tube is configured to include a pit tube protruding in the direction by which the valve cover presses the cylinder and a pit protruding in the direction of the pit tube, connected to the inlet of the discharge muffler part such that the pit tube is inserted and connected while the valve cover progresses in the direction of pressing the cylinder.

Also, the small air compressor according to the present invention is characterized in that the piston is formed with a cut ring insertion end in the front end portion, that an O-ring is inserted into the ring insertion end, and that a fixing ring is inserted into the ring insertion end on the outside thereof to be coupled with the piston.

Also, the small air compressor according to the present invention is characterized in that the O-ring is formed of a Teflon material to have a conical shape inclined in the direction toward the outer diameter from the inner diameter and inserted into the ring insertion end such that the outer diameter is oriented in the front end direction of the piston.

Also, the small air compressor according to the present invention is characterized in that the fixing ring is coupled to the piston by caulking the portion connected with the piston while being inserted into the ring insertion end.

Also, the small air compressor according to the present invention is characterized in that the piston is provided with O-rings in the front end portion and back end portion.

Also, the small air compressor according to the present invention is characterized in that the block is provided with a shaft support hole into which the crankshaft is inserted to be shaft-supported, that a tubular journal is inserted into the shaft support hole, that the crankshaft is inserted into the inside of the journal, and that a bushing made of a resin material is inserted into each opening of the journal at both sides.

Effect of the Invention

By virtue of the aforementioned configuration, the small air compressor according to the present invention has advantages that can reduce cylinder deformation by forming the supporting end at the side of the cylinder and allowing the supporting end to be supported on the block and also, as a result, precisely retain the coupling of the cylinder and the block upon fastening and operating by reducing the length of the press bolt coupling the valve cover and the block.

Also, the small air compressor according to the present invention has advantages of simple structure and easy assembling by forming the suction muffler and the discharge muffler integrally with the block.

Also, the small air compressor according to the present invention has advantages that can reduce the vibration of the crankshaft and improve the durability of the bearing by inserting bushings into the inside of the shaft support hole in the block and installing journal bearings at both ends thereof to support the crankshaft by the journal bearings and also, as a result, allow an oil-free compressor.

Also, the small air compressor according to the present invention has advantages that can reduce the vibration of the piston by installing sealing rings at both upper and lower ends of the piston and also improve wear resistance by forming the sealing ring with a Teflon material, and as a result allow an oil-free compressor.

BRIEF DESCRIPTION OF DRAWINGS

FIG. 1*a* is a view illustrating a structure of a conventional small reciprocating compressor in which a cylinder is integrally formed in a block.

FIG. 1*b* is a view illustrating a coupling structure of a block and a cylinder in a conventional small reciprocating compressor having a structure in which the cylinder manufactured separately is coupled to the block.

FIG. 1*c* is a cross-sectional view illustrating the structure of a piston in a conventional small reciprocating compressor.

FIG. 2*a* to FIG. 2*c* are perspective views illustrating a small air compressor to which a cylinder coupling structure according to one embodiment of the present invention is applied.

FIG. 3 is a plan view illustrating the small air compressor to which the cylinder coupling structure according to one embodiment of the present invention is applied.

FIG. 4 and FIG. 5 are exploded perspective views illustrating the small air compressor to which the cylinder coupling structure according to one embodiment of the present invention is applied.

FIG. 6 is an exploded perspective view illustrating the coupling of a block and a cylinder of the small air compressor to which the cylinder coupling structure according to one embodiment of the present invention is applied.

FIG. 7 is an exploded perspective view illustrating the coupling of the block, the cylinder, a valve assembly and a valve cover of the small air compressor to which the cylinder coupling structure according to one embodiment of the present invention is applied.

FIG. 8 is a perspective view illustrating the state of the coupling of a crankshaft, a connecting rod and a piston of the small air compressor to which the cylinder coupling structure according to one embodiment of the present invention is applied.

FIG. 9 is a perspective view illustrating the valve assembly of the small air compressor to which the cylinder coupling structure according to one embodiment of the present invention is applied.

FIG. 10 is an exploded perspective view illustrating the valve assembly of the small air compressor to which the cylinder coupling structure according to one embodiment of the present invention is applied.

FIG. 11 is a cross-sectional view illustrating the small air compressor to which the cylinder coupling structure according to one embodiment of the present invention is applied.

FIG. 12 is a cross-sectional view illustrating in detail the coupling of the block and the cylinder of the small air compressor to which the cylinder coupling structure according to one embodiment of the present invention is applied.

FIG. 13 is a cross-sectional view illustrating another embodiment of the coupling of the block and the crankshaft of the small air compressor to which the cylinder coupling structure according to one embodiment of the present invention is applied.

FIG. 14*a* to FIG. 14*c* are perspective, exploded perspective and cross-sectional views respectively illustrating the structure of the piston of the small air compressor to which the cylinder coupling structure according to one embodiment of the present invention is applied.

Hereinafter, the present invention is described in detail with reference to the accompanying drawings.

BEST MODE FOR CARRYING OUT THE INVENTION

FIG. 2*a* to FIG. 2*c* are perspective views illustrating a small air compressor to which a cylinder coupling structure according to one embodiment of the present invention is applied; FIG. 3 is a plan view illustrating the small air compressor to which the cylinder coupling structure according to one embodiment of the present invention is applied; FIG. 4 and FIG. 5 are exploded perspective views illustrating the small air compressor to which the cylinder coupling structure according to one embodiment of the present invention is applied; FIG. 6 is an exploded perspective view illustrating the coupling of a block and a cylinder of the small air compressor to which the cylinder coupling structure according to one embodiment of the present invention is applied; FIG. 7 is an exploded perspective view illustrating the coupling of the block, the cylinder, a valve assembly and a valve cover of the small air compressor to which the cylinder coupling structure according to one embodiment of the present invention is applied; FIG. 8 is a perspective view illustrating the state of the coupling of a crankshaft, a connecting rod and a piston of the small air compressor to which the cylinder coupling structure according to one embodiment of the present invention is applied; FIG. 9 is a perspective view illustrating the valve assembly of the small air compressor to which the cylinder coupling structure according to one embodiment of the present invention is applied; FIG. 10 is an exploded perspective view illustrating the valve assembly of the small air compressor to which the cylinder coupling structure according to one embodiment of the present invention is applied; FIG. 11 is a cross-sectional view illustrating the small air compressor to which the cylinder coupling structure according to one embodiment of the present invention is applied; FIG. 12 is a cross-sectional view illustrating in detail the coupling of the block and the cylinder of the small air compressor to which the cylinder coupling structure according to one embodiment of the present invention is applied; FIG. 13 is a cross-sectional view illustrating another embodiment of the coupling of the block and the crankshaft of the small air compressor to which the cylinder coupling structure according to one embodiment of the present invention is applied; and FIG. 14*a* to FIG. 14*c* are perspective, exploded perspective and cross-sectional views respectively illustrating the structure of the piston of the small air compressor to which the cylinder coupling structure according to one embodiment of the present invention is applied.

Referring to the drawings, the small air compressor to which the cylinder coupling structure according to one embodiment of the present invention is applied is configured to include a housing 11, 12, 13, a stator 21, a rotor 25, a crankshaft 30, a connecting rod 34, a block 40, a cylinder 50, a piston 60, a valve assembly 70, a valve cover 80 and a press bolt 90.

The housing 11, 12, 13 is a case for accommodating an assembly in which the stator 21, block 40, etc. are assembled and protecting the assembly, and is configured with a bottom part 11, a tubular side-wall part 12 having the top and bottom opened, extending upward from the outer edge of the bottom part 11, and a cover part 13 for covering the top opening of the side-wall part 12. The bottom part 11, the side-wall part 12 and the cover part 13 are integrally coupled while the bottom part 11 and the side-wall part 12 are sequentially disposed vertically to block the top and bottom openings of the cover part 13, respectively. The housing 11, 12, 13 is preferably sealed to prevent noise generated upon pumping and prevent the leakage of oil such as a lubricant, etc. to the outside.

The stator 21 is to generate a magnetic force for rotating the rotor 25 when electricity is applied, and is fixed to the bottom part 11 of the housing 11, 12, 13. The stator 21 is coupled to a fixing plate 22 in an upright position, in order to fix the stator 21. The fixing plate 22 to which the stator 21 is coupled is supported by four vibration-isolation springs 23 therebeneath and fixed to the bottom part 11 of the housing 11, 12, 13 by a coupling bolt 24. The vibration-isolation spring 23 is to absorb vibration generated upon pumping and prevent the transfer of the vibration to the housing 11, 12, 13. A member other than the vibration-isolation spring 23, such as an anti-vibration pad, may be substituted or added for vibration isolation.

The stator 21 is in contact with stator coupling pillars 46 protruding downward from a shaft support part 41 in the block 40 and integrally coupled with the block 40, as described below.

The rotor 25 is positioned inside the stator 21 to rotate relative to the stator 21. The crankshaft 30 is coupled to the rotor 25 to rotate integrally with the rotor 25.

The crankshaft 30 is coupled with the rotor 25 to rotate integrally with the rotor 25 and rotatably shaft-supported on the block 40. Referring to the drawings, as to the crankshaft 30, a crank part 32 to which the connecting rod 34 is connected is integrally formed on the top of a shaft part 31, and an oil feeder 33 for moving a lubricant contained in the bottom part 11 of the housing 11, 12, 13 to the crankshaft 30 is coupled to the bottom of the shaft part 31. The lubricant pumped by the oil feeder 33 is supplied to the surface of the crankshaft 30 along an oil path 311 such as a groove or hole formed in the crankshaft 30.

The shaft part 31 in the crankshaft 30 is shaft-supported on a shaft support part 41 in the block 40. A shaft hole 47 penetrating in the up and down direction is formed in the shaft support part 41 of the block 40. The shaft part 31 is rotatably inserted into a journal 35 inserted into the shaft hole 47 to be shaft-supported.

The crank part 32 in the crankshaft 30 relates to a cam device together with the connecting rod 34 for converting the rotation of the crankshaft 30 into a reciprocating motion of the piston 60.

The connecting rod 34 has both ends connected to the crankshaft 30 and the piston 60, respectively, to convert a rotary motion of the crankshaft 30 into a linear reciprocating motion of the piston 60. Referring to the drawings, the connecting rod 34 has a structure that is divided into a rod part 341 connected to the piston 60 with a connecting pin 66 and a journal part 342 connected to the crank part 32 in the crankshaft 30. The rod part 341 and the journal part 342 divided are connected to each other by a connection pin 343. Particularly, the connection pin 343 has a position by which the axial direction thereof is twisted perpendicular to the axial direction of the crankshaft 30 such that the rod part 341 and the journal part 342 are rotatable relative to each other around the axis of the connection pin 343. Thus, a bending force imposed on the connecting rod 34 by the axial displacement of the crankshaft 30 can be absorbed.

The block 40 is to shaft-support the crankshaft 30 and to have the cylinder 50 coupled thereto.

The present invention is characterized by having a structure in which the cylinder 50 is not formed integrally to the block 40, but the cylinder 50 is separately formed and coupled to a cylinder coupling part 42 in the block 40. Referring to the drawings, the block 40 is formed to include a shaft support part 41 of a plate type in the horizontal direction on which the crankshaft 30 is shaft-supported and a cylinder coupling part 42 of a plate type standing vertically with respect to the shaft support part 41.

The shaft support hole 47 is formed in the shaft support part 41 of the block 40, and the tubular journal 35 is insertedly fixed to the shaft support hole 47. The crankshaft 30 is inserted into the journal 35 to be shaft-supported.

The journal 35 supports smooth rotation of the crankshaft 30 and is made of a material such as bronze having wear resistance such that the crankshaft 30 is supported on the journal 35 in slidingly direct contact thereto. FIG. 10 and FIG. 12 are the cross-sectional views illustrating this structure.

Meanwhile, according to the present invention, the crankshaft 30 may be formed not to be directly supported on the journal 35 but to be supported by bushings 351, 352 made of a resin material coupled to the openings of the journal 35 at both sides, respectively. FIG. 13 illustrates an embodiment in which the bushings 351, 352 made of a resin material such as polyphenylene sulfide (PPS) having excellent thermal resistance and wear resistance are inserted into the openings of the journal 35 at both sides, respectively, and the shaft part 31 in the crankshaft 30 is inserted into the bushings 351, 352 to be supported. As illustrated in FIG. 13, in the case where the crankshaft 30 is supported by the bushings 351, 352 made of a resin material, the feeding of oil is reduced, or an oil-free shaft support structure without the need of oiling itself is secured. In the case of the oil-free shaft support, the present invention may eliminate the configuration on the aforementioned oil feeder 33 or oil path 311, and accordingly can facilitate reduction of weight and compactness.

The present invention has a structure in which the cylinder 50 is manufactured separately from the block 40 and coupled to the cylinder coupling part 42 in the block 40. A cylinder insertion hole 45 disposed vertically with respect to the shaft support hole 47 is formed in the cylinder coupling part 42. The cylinder insertion hole 45 is penetratingly formed such that one end portion of the cylinder 50 is inserted into the cylinder coupling part 42. The cylinder insertion hole 45 forms a step such that the inner diameter on the side where the crankshaft 30 is positioned is smaller, and the diameter on the other side opposite the side where the crankshaft 30 is positioned is greater. Due to the step, a supporting end 451 is formed for a latching end 53 in the cylinder 50 to be supported. The cylinder 50 is inserted into the cylinder insertion hole 45 and the latching end 53 is latched and supported on the supporting end 451 formed by the step formed in the inner wall of the cylinder insertion hole 45.

In the cylinder insertion hole 45, a guide protrusion 452 corresponding to a guide groove 54 formed in the outer wall of the cylinder 50 for guiding the insertion of the cylinder 50 is formed to be long in the longitudinal direction in the portion having a greater diameter in the inner wall of the cylinder insertion hole 45. The cylinder 50 moves only in the longitudinal direction and is inserted into the cylinder insertion hole 45 by which the guide protrusion 452 is inserted into the guide groove 54 formed on the outer surface of the cylinder 50 while the cylinder 50 is inserted into the cylinder insertion hole 45.

Meanwhile, the present invention has a structure in which a suction muffler 43 and a discharge muffler 44 for reducing noise generated from pulsation of a fluid upon pumping are integrally formed with the block 40. Referring to the drawings, the suction muffler 43 and the discharge muffler 44 are formed at both sides of the shaft support part 41 supporting the shaft, respectively. Particularly, the cylinder coupling part 42 is positioned between the suction muffler 43 and the discharge muffler 44. The end portion of each of the suction muffler 43 and the discharge muffler 44 is coupled to each of both sides of the shaft support part 41 such that the suction muffler 43, the cylinder coupling part 42, and then the discharge muffler 44 are interconnected with each other in a "⊏" arrangement shape to form a structure reinforcing the rigidity of the block 40. The suction muffler 43 is formed with an inlet 431 through which a fluid flows in and an outlet 432 through which a fluid flows out. A suction filter 43*a* is coupled to the inlet 431 in the suction muffler 43 to filter foreign materials contained in air or a refrigerant suctioned. A suction connection tube 93 is connected to the outlet 432 in the suction muffler 43 such that the suction muffler 43 is connected to a suction space 81*a* in the valve cover 80. Also, the discharge muffler 44 is formed with an inlet 441 through which a fluid flows in and an outlet 442 through which a fluid flows out. A discharge connection tube 94 is connected to the inlet 441 in the discharge muffler 44 such that the discharge muffler 44 is connected to a discharge space 81*b* in the valve cover 80. A tube connector 44*a* is coupled to the outlet 442 in the discharge muffler 44.

The cylinder 50 is formed to have a circular tube-shaped body to form a space in which fluid such as air or a refrigerant is compressed by the reciprocating motion of the piston 60. The present invention is characterized in that the cylinder 50 is formed separately from the block 40 and coupled to the block 40. Particularly, the present invention has a structure in which the latching end 53 is formed in the side portion of the cylinder 50, and the latching end 53 is latched and supported on the supporting end 451 formed inside the cylinder insertion hole 45 in the block 40. Referring to the drawings, the cylinder 50 forms a small-diameter part 51 having a smaller outer diameter on the side inserted into the cylinder insertion hole 45 in the block 40 and a great-diameter part 52 having an outer diameter greater than the small-diameter part 51 on the side coupled to the valve assembly 70 and the valve cover 80, such that a step formed by the small-diameter part 51 and the great-diameter part 52 forms the latching end 53. The small-diameter part 51 is inserted into the portion having a smaller inner diameter in the cylinder insertion hole 45, and the great-diameter part 52 is inserted into the portion having a greater inner diameter in the cylinder insertion hole 45 such that the latching end 53 is latched and supported on the supporting end 451 in the cylinder insertion hole 45. That is, the press bolt 90 fastens the block 40 and the valve cover 80 such that the valve cover 80 presses the front end of the cylinder 50 while the latching end 53 in the cylinder 50 is latched and supported on the supporting end 451, and thereby the cylinder 50 is coupled to the block 40. The guide groove 54 is formed on the outer surface of the cylinder 50 for the guide protrusion 452 formed on the inner surface of the cylinder insertion hole 45 to be inserted thereinto such that the cylinder 50 is guided while being inserted into the cylinder insertion hole 45, and that the cylinder 50 does not rotate when inserted into the cylinder insertion hole 45 and coupled to the block 40, as disclosed above. Referring to the drawings, the guide groove 54 is formed by cutting the great-diameter part 52 in a certain depth in the longitudinal direction of the cylinder 50 starting from the latching end 53 in the cylinder 50.

Meanwhile, the drawings illustrate an embodiment in which the guide protrusion 452 is formed on the inner surface of the cylinder insertion hole 45, and the guide groove 54 is formed on the outer surface of the cylinder 50, but these elements may be formed in the opposite positions. That is, as opposed to the embodiment illustrated in the drawings, the guide protrusion may be formed on the outer surface of the cylinder 50, and the guide groove may be formed on the inner surface of the cylinder insertion hole 45.

The piston 60 reciprocates inside the cylinder 50 to compress and emit the fluid such as air or a refrigerant suctioned inside the cylinder 50. The piston 60 is connected to the connecting rod 34 for converting the rotary motion of the crankshaft 30 into a linear motion by the connecting pin 66 and performs a linear reciprocating motion.

Meanwhile, the present invention has a structure capable of improving the assemblability and compression sealability of the piston 60. FIG. 14*a* to FIG. 14*c* illustrate in detail the structure of the piston 60. Referring to FIG. 14*a* to FIG. 14*c*, the piston 60 has a structure in which O-rings 63, 65 are installed in the front end and back end of a body 61 of tube-shaped body having the front end closed and the back end opened, respectively. Since the O-rings 63, 65 are installed in the front end and back end, respectively, as above, and the front end and back end of the piston 60 are closely supported on the inner surface of the cylinder 50, sealability can be improved, and the vibration of the piston 60 inside the cylinder 50 can be prevented. The present invention has the O-rings 63, 65 formed of a Teflon material, not a rubber material, to secure sealability and also secure mechanical properties such as wear resistance, etc. As a result, the feeding of oil to the inner wall of the cylinder 50 can be reduced or removed, and thus an oil-free compressor can be implemented. Particularly, by adopting O-rings 63, 65 made of a Teflon material as above, the present invention has a structure to easily couple the O-rings to the piston 60, in which ring insertion ends 611, 612 are cut and formed in the front end portion and back end portion of the body 61 in the piston 60, respectively, first O-rings 63, 65 are inserted into the cut insertion ends 611, 612, respectively, and then fixing rings 62, 64 are inserted on the outside thereof and fixed to the piston 60, and thereby the O-rings 63, 65 are coupled to the piston 60. The fixing rings 62, 64 may be press-inserted into the ring insertion ends 611, 612 to be coupled with the piston 60. The fixing rings 62, 64 may be coupled to the body 61 in the piston 60 by caulking the portion connected with the body 61 in the piston 60 while being inserted into the ring insertion ends 611, 612, at the same time of press-insertion coupling or separately from press-insertion coupling.

Meanwhile, the O-ring 63 coupled to the front end portion of the piston body 61, among the O-rings 63, 65, mainly seals the gap between the cylinder 50 and the piston 60. The present invention has a structure in which the O-ring 63 coupled to the front end portion of the body 61 is formed of a Teflon material, as disclosed above, and is formed of a Teflon material to have a conical shape inclined in the direction toward the outer diameter of the O-ring 63 coupled to the front end portion of the body 61 from the inner diameter such that the outer diameter is oriented in the front end direction of the piston 60, to endure compression pressure. FIG. 14*c* conceptually illustrates a state in which the O-ring 63 coupled to the front end portion of the body 61 is deformed to be inclined such that the outer rim is oriented to the front end portion of the piston 60, and thus a donut-shaped plate (in solid line) becomes a conical shape (in dotted line).

The valve assembly 70 is provided with a suction valve and a discharge valve and blocks the front end of the cylinder. FIG. 9*a* and FIG. 9*b* are perspective and exploded perspective views illustrating in detail the valve assembly 70. Referring to the drawings, the valve assembly 70 is provided with a valve plate 71 blocking the opening in the front end of the cylinder 50. A suction inlet 711 connecting the suction space 81*a* formed by the valve cover 80 and the compression space formed inside the cylinder 50 is formed in the valve plate 71. Also, a discharge outlet 712 connecting the discharge space 81*b* formed by the valve cover 80 and the compression space formed inside the cylinder 50 is formed in the valve plate 71. A suction valve flip 73 made of an elastic material is coupled to the inside of the valve plate 71 such that the suction inlet 711 is opened only in the direction by which a fluid is suctioned into the compression space in the cylinder 50 from the suction space 81*a*. Also, a discharge valve flip 74 made of an elastic material is coupled to the outside of the valve plate 71 such that the discharge outlet 712 is opened only in the direction by which a fluid is discharged to the discharge space 81*b* from the compression space in the cylinder 50.

Meanwhile, in order to prevent excessive opening of the discharge valve flip 74, a valve stopper 75 is coupled to the outside of the valve plate 71 to be positioned on the top of the discharge valve flip 74. The valve stopper 75 has a shape corresponding to the discharge valve flip 74 and is coupled to the outside of the valve plate 71 simultaneously with the discharge valve flip 74 by a rivet 76 fastened to a rivet fastener 714 formed in the valve plate 71.

Meanwhile, an emission outlet 713 to which the discharge connection tube 94 connecting the discharge space 81*b* and the discharge muffler 44 is connected is formed in the valve plate 71 such that the compressed fluid discharged to the discharge space 81*b* in the valve cover 80 is emitted to the discharge muffler 44.

The valve assembly 70 coupled as above is disposed to block the opening in the front end of the cylinder 50 and is coupled to the cylinder 50 together with the valve cover 80 by the fastening of the press bolt 90. In order to seal the portion contacting the cylinder 50, a cylinder gasket 91 is provided in the edge of the opening in the front end of the cylinder 50, and a plate gasket 72 is provided in the inner surface of the valve plate 71. A flip receiving hole 721 is formed in the plate gasket 72 for the suction valve flip 73 to be received. A discharge hole 722 is formed so as not to block the discharge outlet 712 in the valve plate 71.

The valve cover 80 covers the valve assembly to cover the top of the valve assembly 70 and form the suction space 81*a* and the discharge space 81*b* on the top of the valve assembly 70. A diaphragm 81 is formed inside the valve cover 80 to partition the suction space 81*a* and the discharge space 81*b* and is coupled to the top of the valve plate 71 to cover the top of the valve plate 71 while a cover gasket 92 is interposed therebetween for sealing. The present invention has a structure in which as the valve cover 80 is coupled to the block 40 by the press bolt 90, the valve cover 80 presses the valve assembly 70 and then the cylinder 50 is pressed and coupled to the block 40.

The press bolt 90 is to couple the cylinder 50, the valve assembly 70 and the valve cover 80 integrally to the block 40, as disclosed above. Referring to the drawings, the press bolt 90 performs the coupling by which a bolt head is caught in the valve cover 80 and the front end of the blot is screw-fastened to the block 40, while the cylinder 50 and the valve assembly 70 are disposed sequentially between the valve cover 80 and the block 40, such that the latching end 53 in the cylinder 50 is latched on the supporting end 451 in the cylinder insertion hole 45 and the cylinder 50 is pressed to the block 40.

The suction connection tube 93 is a tube body for connecting the suction muffler 43 and the suction space 81*a* in the valve cover 80. Referring to the drawings, the suction connection tube 93 has one end connected to the outlet 432 in the suction muffler 43 and the other end connected to the inlet formed in the suction space 81*a* in the valve cover 80. Meanwhile, the present invention is characterized in that an auxiliary muffler part 931 is formed in the suction connection tube 93 to reduce noise generated from suction pulsation of a fluid together with the suction muffler 43. The auxiliary muffler part 931 is accomplished by an expanded space.

The discharge connection tube 94 is a tube body for connecting the discharge muffler 44 and the discharge space 81*b* in the valve cover 80. Referring to the drawings, the discharge connection tube 94 has one end connected to the inlet 441 in the discharge muffler 44 and the other end connected to the emission outlet 713 formed in the discharge space 81*b* of the valve cover 80.

Meanwhile, the present invention has a structure in which the discharge connection tube 94 is divided into a pit tube 942 and a pit 941 for coupling to be readily assembled while the cylinder 50, the valve assembly 70 and the valve cover 80 are coupled to the block 40 by the press bolt 90. Referring to the drawings, the pit tube 942 is connected to the emission outlet 713 in the valve plate 71, protruding in the progress direction by which the valve cover 80 presses the cylinder. Also, the pit 941 is connected to the inlet 441 in the discharge muffler part 44, protruding in the direction toward the pit tube 942 such that the pit tube 942 is inserted and connected while the valve cover 80 progresses in the direction of pressing the cylinder 50.

The drawings illustrate a state in which the pit tube 942 is inserted into the pit 941 and coupled thereto, for the sake of convenience. The pit tube 942 is coupled to the valve plate 71 in advance, and the pit tube 942 and the pit 941 are coupled to each other while the distal end of the pit tube 942 is inserted into the opening of the pit 941 connected to the discharge muffler part 44 when assembling the valve cover 80.

The cylinder coupling structure of the small air compressor as disclosed above and illustrated in the drawings is only one embodiment for carrying out the present invention, and should not be construed as limiting the technical idea of the present invention. The protection scope of the present invention is defined only by the matters set forth in the accompanying claims. In addition, embodiments modified and improved without deviating from the gist of the present invention should be construed as falling within the protection scope of the present invention.

What is claimed is:

1. A small air compressor comprising: a block; a cylinder having a tube-shaped body, coupled to the block; a valve assembly provided with a suction valve and a discharge valve, blocking the front end of the cylinder; a valve cover covering the valve assembly to form a suction space and a discharge space on the top of the valve assembly; at least one press bolt coupling the valve cover and the block such that the cylinder is pressed between the valve cover and the block; a piston reciprocating inside the cylinder; a stator coupled to the block; a rotor positioned to rotate relative to the stator; a crankshaft coupled with the rotor to rotate integrally with the rotor, rotatably shaft-supported on the block; and a connecting rod having both ends connected to the crankshaft and the piston, respectively, to convert a rotary motion of the crankshaft into a linear reciprocating motion of the piston, wherein the block is provided with a supporting end by which the cylinder is pressed to be supported, a latching end is formed on the outer surface of the cylinder, and the press bolt is fastened to the block and the valve cover such that the valve cover presses the front end of the cylinder while the latching end of the cylinder is fixed and supported on the supporting end, wherein the block is formed integrally with a suction muffler part and a discharge muffler part, each having an inlet and an outlet, wherein a suction connection tube is connected to the outlet of the suction muffler part such that the suction muffler part is connected to the suction space of the valve cover, wherein a discharge connection tube is connected to the inlet of the discharge muffler part such that the discharge muffler part k connected to the discharge space of the valve cover, wherein a cylinder coupling part k positioned between the suction muffler and the discharge muffler, wherein an end portion of each of the suction muffler and the discharge muffler is coupled to each of both sides of a shaft support part such that the suction muffler, the cylinder coupling part, and the discharge muffler are interconnected with each other to reinforce the block, wherein the discharge connection tube is divided into a pit tube and a pit tube receiving tube, the pit tube being connected to an emission outlet in a valve plate, and the pit tube protruding from the valve plate in the direction in which the valve cover presses the cylinder, and the pit tube receiving tube being connected to the inlet in the discharge muffler part, and protruding in the direction toward the pit tube such that the pit tube is inserted into and connected to the pit tube receiving tube which protrudes from the valve plate in the direction in which the valve cover presses the cylinder.

2. The small air compressor according to claim 1, wherein the block is formed with a cylinder insertion hole penetrating therethrough into which one end portion of the cylinder is inserted, the supporting end is formed by a step formed in the inner wall of the cylinder insertion hole, and the cylinder is inserted into the cylinder insertion hole and the latching end is latched and supported on the supporting end.

3. The small air compressor according to claim 2, wherein a guide protrusion is formed on any one of the inner surface of the cylinder insertion hole and the outer surface of the cylinder contacting each other, and a guide groove into which the guide protrusion is inserted while the cylinder is inserted into the cylinder insertion hole is formed on the other one of the inner surface of the cylinder insertion hole and the outer surface of the cylinder.

4. The small air compressor according to claim 1, wherein the suction connection tube is formed with an auxiliary suction muffler part.

5. The small air compressor according to claim 1, wherein the piston is formed with a cut ring insertion end in the front end portion, an O-ring is inserted into the ring insertion end, and a fixing ring is inserted into the ring insertion end on the outside thereof to be coupled with the piston.

6. The small air compressor according to claim 5, wherein the O-ring is formed of a Teflon material to have a conical shape inclined in the direction toward the outer diameter from the inner diameter and inserted into the ring insertion end such that the outer diameter is oriented in the front end direction of the piston.

7. The small air compressor according to claim 5, wherein the fixing ring is coupled to the piston by caulking the portion connected with the piston while being inserted into the ring insertion end.

8. The small air compressor according to claim 1, wherein the piston is provided with O-rings in the front end portion and back end portion.

9. The small air compressor according to claim 1, wherein the block is provided with a shaft support hole into which the crankshaft is inserted to be shaft-supported, a tubular journal is inserted into the shaft support hole, the crankshaft is inserted into the inside of the journal, and a bushing made of a resin material is inserted into each opening of the journal at both sides.

* * * * *